US005860400A

United States Patent [19]

Stuart et al.

[11] Patent Number: 5,860,400

[45] Date of Patent: Jan. 19, 1999

[54] INTAKE-EXHAUST MANIFOLD BRIDGE NOISE ATTENUATION SYSTEM AND METHOD

[75] Inventors: Philip E. A. Stuart; Ian R. McLean, both of Chatham, Canada

[73] Assignee: Siemens Electric Limited, Tilbury, Canada

[21] Appl. No.: 932,417

[22] Filed: Sep. 17, 1997

[51] Int. Cl.[6] ..... F02F 7/00

[52] U.S. Cl. ..... 123/184.53; 181/204; 181/206

[58] Field of Search ..... 123/184.21, 184.61, 123/184.53; 181/206, 204

[56] References Cited

U.S. PATENT DOCUMENTS

| | | | |
|---|---|---|---|
| 4,080,945 | 3/1978 | Hikosaka et al. | 181/204 |
| 4,109,108 | 8/1978 | Coxon et al. | 181/206 |
| 4,257,368 | 3/1981 | Hofbauer | 181/204 |
| 5,446,790 | 8/1995 | Tanaka et al. | 123/206 |
| 5,541,373 | 7/1996 | Cheng | 181/206 |

*Primary Examiner*—Marguerite McMahon

[57] ABSTRACT

A system and method of attenuating noise generated in a multicylinder internal combustion engine as a result of opening and closing of the exhaust and intake valves in which cross passages extend between regions of the exhaust and intake manifolds adjacent the exhaust and intake valves of different cylinders in which the exhaust and intake valves open at approximately the same time. The acoustic waves of the noise caused by opening of the exhaust and intake valves respectively are set in mutual opposition to each other to thereby substantially cancel each other. A low mass flexible diaphragm in each cross passage prevents cross flow of exhaust gases while allowing transmission of the acoustic waves. Porous plugs restrict flow to the diaphragm while being sufficiently open to allow free transmission of the noise sound waves to the diaphragm to not impair the mutual cancellation process.

10 Claims, 3 Drawing Sheets

INTAKE-EXHAUST MANIFOLD BRIDGE NOISE ATTENUATION SYSTEM AND METHOD

BACKGROUND OF THE INVENTION

This invention concerns internal combustion engines and more particularly noise reduction systems and methods for engine intake and exhaust systems. Engines commonly employed for automotive use have intake and exhaust valves which are rapidly opened and closed at timed intervals during the engine cycle.

Much development effort has been exerted to produce quieter running passenger vehicles, and specifically to eliminating engine noise.

Exhaust muffler systems have long been employed and more recently resonators and expansion chambers on the air intake systems. Such devices are bulky since the exhaust gases and air flows must be expanded to large volumes to reduce the noise levels.

A more exotic approach has been active noise attenuation systems involving the use of microphones, amplifiers, and speakers to generate cancellation sound waves 180° out-of-phase with detected noise sound waves. This approach requires significant electrical power and considerable equipment to execute.

The major source of noise in the exhaust and air induction passages is generated by the sudden opening and closing of the exhaust and intake valves during the engine cycle to enable the intake, compression, power, and exhaust engine phases in each cylinder to proceed in the well known manner. The sudden opening and closing of the valves create acoustic waves due to the inertia of the gas streams in the connected passages. That is, the arrested exhaust gas flow into an exhaust passage by the exhaust valve suddenly closing creates a rarefaction zone near the exhaust valve as the downstream exhaust flow persists as a result of the inertia of the exhaust gas. A compression zone near the exhaust valve is created as the exhaust flow is initiated in a stationary volume of exhaust gas downstream from a suddenly opening exhaust valve. The arrested intake air flow from an intake passage by the intake valve suddenly closing creates a compression zone near the intake valve as the upstream intake air flow persists as a result of the inertia of the intake air. A rarefaction zone near the intake valve is created as the intake flow is initiated in a stationary volume of intake gas upstream from a suddenly opening intake valve.

These compression and rarefaction zones propogate as acoustic waves travelling at the speed of sound through the manifold passages in either the intake or exhaust systems and finally emanate from the air intake in the induction system or the exhaust tailpipe in the exhaust system.

It is the object of the present invention to attenuate noise generated in this fashion in an internal combustion engine without using bulky mufflers, expansion chambers, resonators and the like, and without expending electrical power and necessitating complex equipment.

SUMMARY OF THE INVENTION

The above objects are achieved in a multicylinder engine having intake and exhaust valves of different cylinders opening and closing at substantially the same time.

A connecting cross passage creates fluid communication between respective manifold locations adjacent the exhaust and the intake valves of different cylinders opening at the same time so as to cause the acoustic waves generated by gas compression and rarefaction to be placed in mutual opposition to each other and thereby be substantially cancelled.

The cross passages each have a partitioning flexible diaphragm mounted therein preventing free flow of exhaust gases into the air induction system. This avoids overheating of the air intake system while allowing transmission of the cancelling sound waves across the diaphragm. The diaphragm is of low surface mass density to transmit low frequency sound waves with small losses.

The diaphragm in each cross passage is supported to resist high static pressure differential by a porous plug positioned on each side of the diaphragm. The porosity of each plug is sufficiently great to be transparent to the low frequency acoustic waves generated.

The powerful sound waves generated are used to cancel each other without resorting to complex active systems, while the cross passage array occupies a much lower volume than prior art resonators, mufflers, etc.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1A:
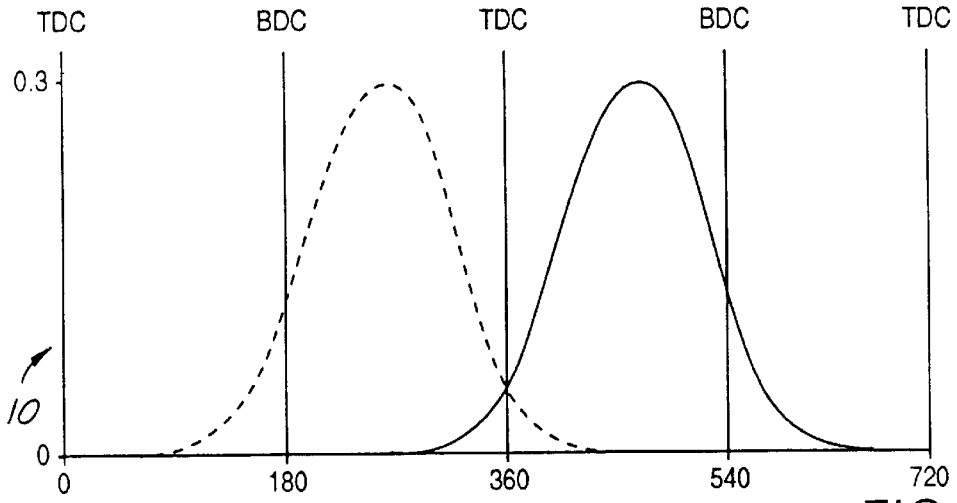
FIGS. 1A–1C are diagrams of the valve system of a representative four cylinder engine depicting the acoustic waves generated by opening and closing of the intake and exhaust valves.
Figure 1B:
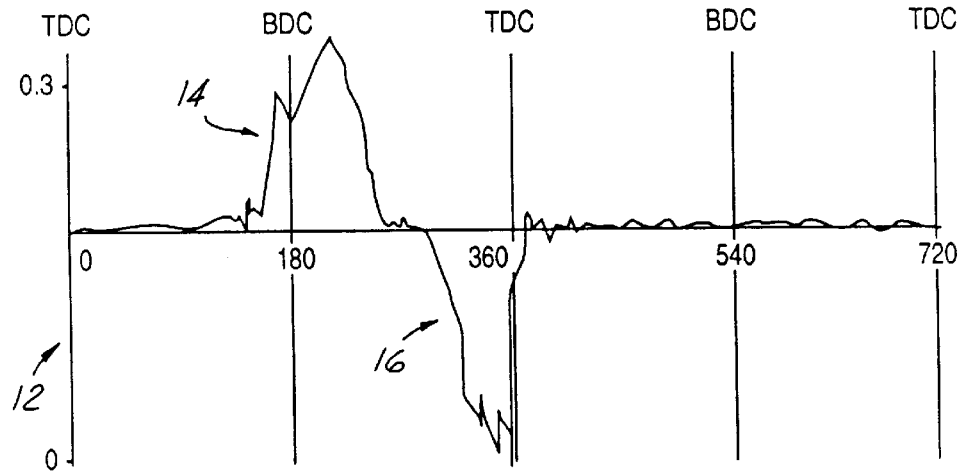
Figure 1C:
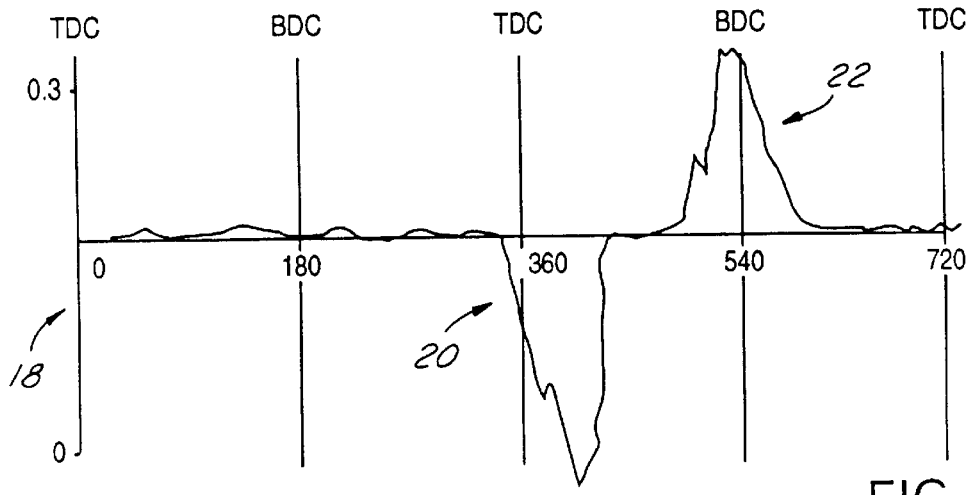

Referring to FIG. 1A, the first plot 10 shows the lift of the exhaust valve (in hidden lines) and the lift of the intake valve (in solid lines) over two crankshaft revolutions, the exhaust lift mainly taking place between 180°–360° of crankshaft rotation, the intake valve lift executed approximately 180° later in the cycle.

Plot 12 shows a trace for each corresponding acoustic wave generation produced by opening and closing of the exhaust valve. As the exhaust valve opens, fluid inertia causes a compression sound wave 14 to be generated, while closing of the valve causes a corresponding rarefaction wave 16 to be generated, as a result of fluid inertia, both propagated at the speed of sound through the associated exhaust manifold runner.

Plot 18 shows the same thing for the intake valve, in which opening of the intake valve creates a rarefaction wave 20 to be generated and upon closing a compression wave 22.

It can be understood that these sound waves are substantially inversions of each other, such that combining them would achieve substantially complete cancellation of each other.

Figure 2:
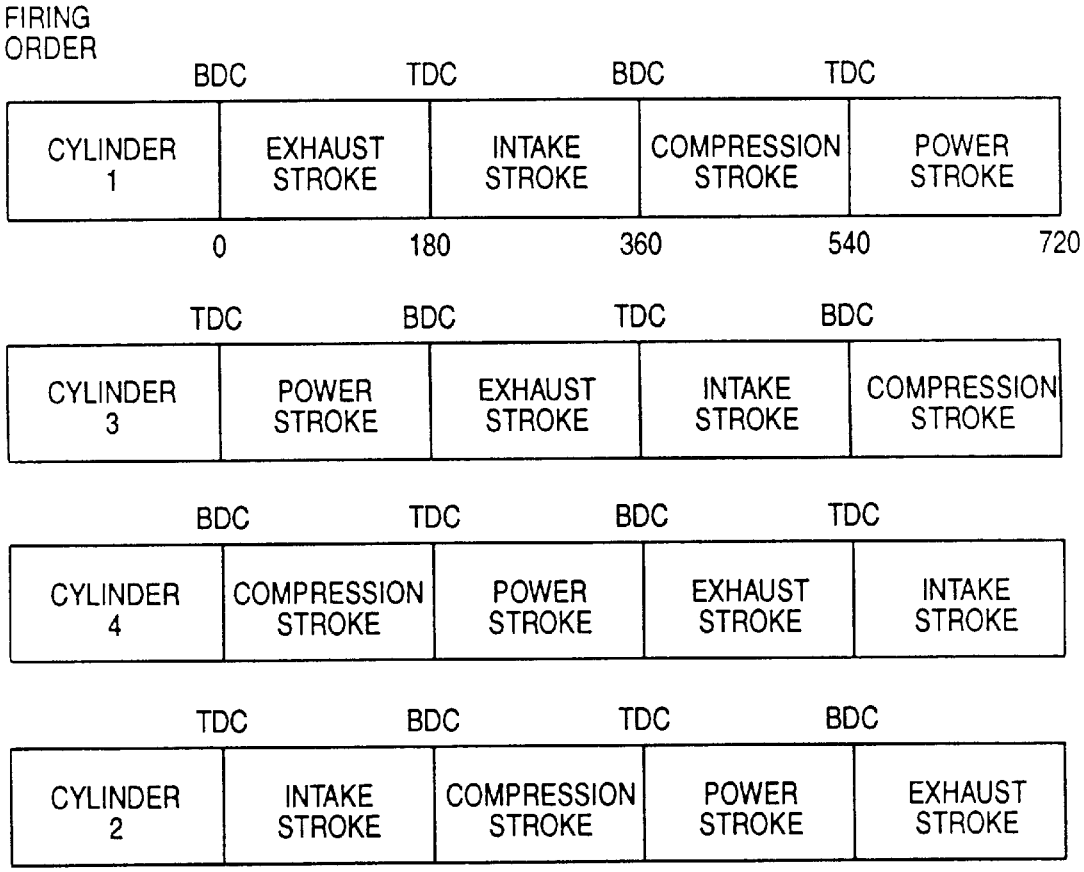
FIG. 2 is a table showing the relationship between the cycles of each cylinder in a four cylinder engine having a 1-3-4-2 firing order.

The chart of FIG. 2 shows the phase relationship between the engine cycles of each cylinder of a four cylinder engine and degrees of crankshaft rotation for a 1-3-4-2 firing order.

Since the engine cycles of each cylinder are out of phase with each other, there is generation of these inverted sound waves in certain cylinders at the same time.

According to the concept of the present invention, cross passages are provided between exhaust and intake manifold runners associated with the exhaust and intake valves of the cylinders in which these waves are simultaneously generated.

Figure 3:
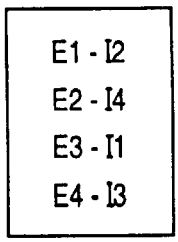
FIG. 3 is a table showing the cross passage connections according to the concept of the present invention.

FIG. 3 is a chart showing the cross connection for the four cylinder engine described.

That is, the exhaust runner of cylinder 1($E_1$) is placed in communication with the intake of the cylinder 2($l_2$), $E_2$ with $l_4$, $E_3$ with $l_1$, and $E_4$ with $l_3$.

Figure 4:
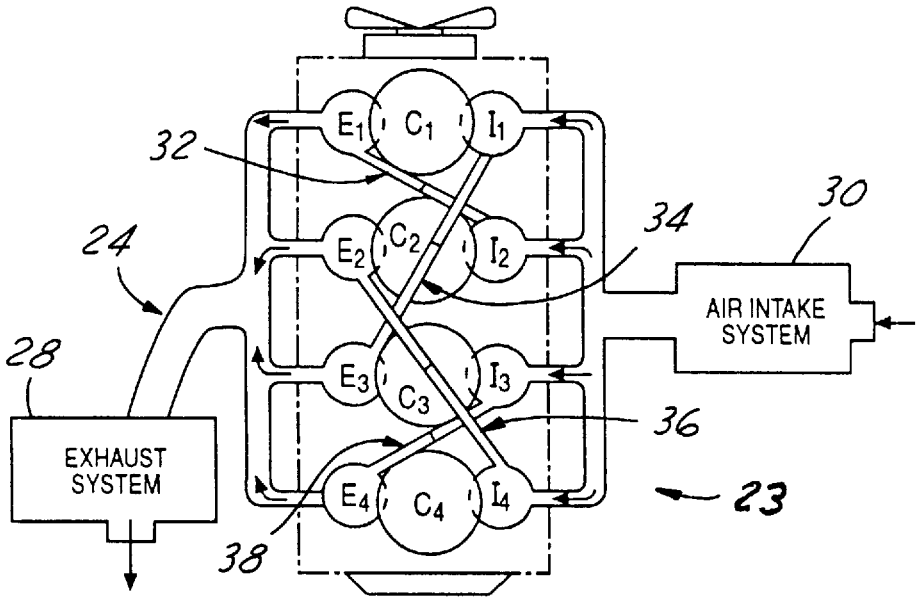
FIG. 4 is a diagram of a four cylinder engine showing the connections according to the chart in FIG. 3.

This is illustrated diagrammatically in FIG. 4 for a four cylinder engine 23 having an exhaust manifold 24 and intake manifold 26 connected respectively with an exhaust system 28 and air induction system 30.

Four cross passages 32, 34, 36, 38 extend between exhaust and intake manifold runners to establish fluid communication as described. Thus, as reverse sound waves propagated in the cross passages 32–38 reach each other, they will largely cancel each other.

The diameter and length of each cross passage should be selected to tune the passages to achieve the interference or cancellation of the sound waves by application of known acoustic design principles.

Figure 5:
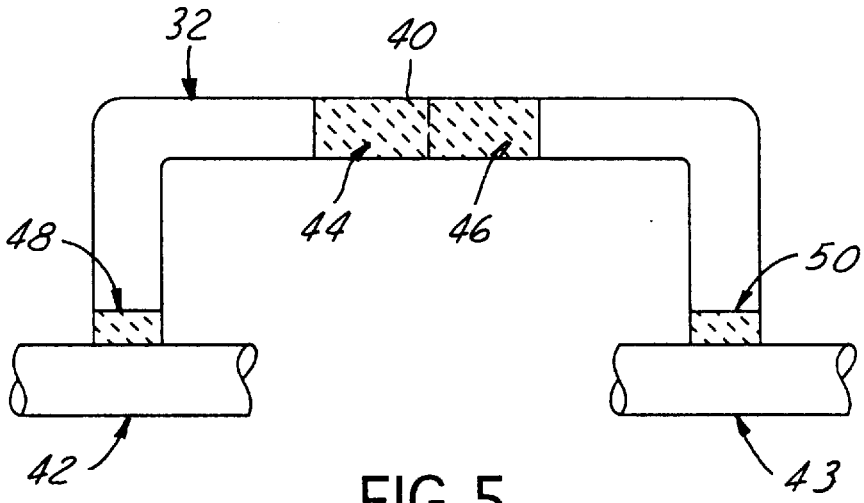
FIG. 5 is a sectional view taken through a representative cross passage, together with fragmentary portions of associated intake and exhaust manifold runners.

Since the intermixing of highly pressurized pressure exhaust gases into the intake air will result in overheating of the intake manifold, a separation diaphragm arrangement is provided as shown in FIG. 5, which includes a low mass flexible diaphragm 40 constructed of a durable material able to withstand exposure to exhaust gases, the diaphragm 40 mounted to extend across and partition each respective cross passage 32, 34, 36 and 38 (cross passage 32 shown as representative of these).

The cross passage 32 is connected to an exhaust manifold runner 42 at one end and an intake manifold 42 at the other end.

The flexible diaphragm 40 allows transmission of the sound waves with only slight losses in order to achieve cancellation while preventing intermixing of the intake air and exhaust gases.

Since a large static pressure difference will typically occur, the diaphragm 40 must be supported to resist excessive stretching. This is accomplished by porous plugs 44, 46 closely positioned on either side of the diaphragm 40.

Damping porous plugs 48 and 50 are also provided to further protect the diaphragm from the hot exhaust gases.

The porous plugs 44, 46, 48, and 50 are preferably constructed of a sintered ceramic material.

It has been established that a porosity of at least 20% will allow free transmission of low frequencies sound, i.e., will be acoustically transparent.

The acoustic transmission loss for the thin flexible diaphragm is given by the "mass law":

$$\text{Transmission loss (db)}=20 \log (f_{\rho s})-48$$

where:

f=frequency ($H_z$)

$\rho_s$=surface mass density (kg/m$^2$)

Note that surface mass density is simply the product of the material density and the wall thickness, i.e., $$\rho_s=\rho\times t$$

where

ρ=material density (kg/m$^3$)

t=wall thickness (m)

Thus, the porous plugs 44, 46, 48, 50 and diaphragm 40 can be designed for low transmission losses while effectively protecting against the effects of high temperature exhaust gases flowing out of the exhaust manifold.

It may be advantageous to provide some openings in the diaphragm 40 to allow limited flow of exhaust gas into the intake air flow.

Accordingly, a low volume noise cancellation system is effected without requiring a powered, active cancellation components to achieve the object of the invention.

We claim:

1. An engine noise attenuation system for a multicylinder internal combustion engine, each cylinder having an exhaust and intake valve set communicating with exhaust and intake manifolds respectively through runner passages, each valve in each set opened and closed at differing times from each other during the engine cycle, said system comprising a series of cross passages, each placing exhaust and intake manifold runners of different cylinders, whereat said opening of respective exhaust and intake valves occurs at approximately the same time in fluid communication with each other so as to enable propagation of rarefaction and compression sound waves in opposition to each other to cause substantial mutual cancellation thereof.

2. The system according to claim 1 further including a positioning flexible diaphragm in each of said cross passages at least partially isolating respective portions of said cross passages associated with exhaust and intake manifold runners from each other.

3. The system according to claim 2 further including a porous plug on either side of each flexible diaphragm closed spaced thereto to provide support therefor against excessive distension from large static differential pressure between each portion of said cross passages.

4. The system according to claim 3 further including an additional porous plug in each end of each cross passages adjacent a point of connection to a respective manifold runner.

5. The system according to claim 3 wherein each porous plug has a porosity of at least 20%.

6. A method of attenuating noise generated by opening and closing of exhaust and intake valves of a multi cylinder internal combustion engine comprising the steps of:

placing in fluid communication respective sets of regions of an exhaust manifold and an intake manifold adjacent exhaust and intake valves of respective engine cylinders whereat said exhaust and intake valves open at the same time; and, causing transmission of sound waves generated to propagate into opposition to each other, thereby substantially mutually cancelling each other.

7. The method according to claim 6 wherein said step of placing said respective sets of regions of said intake and exhaust manifolds in fluid communication comprises the step of extending a cross passage between said regions in each respective set.

8. The method according to claim 7 further including the step of interposing a flexible diaphragm between respective ends of each cross passage to thereby at least partially isolate exhaust and air flow from each other while transmitting noise acoustic waves.

9. The method according to claim 8 further including the step of placing a porous plug on each side of each flexible diaphragm closely spaced thereto to support each diaphragm against excessive distension as a result of large static pressure differentials in said exhaust and intake manifolds.

10. The method according to claim 9 further including the step of mounting additional porous plugs at each end of each cross passage to further inhibit flow to said diaphragm while allowing free transmission of sound waves through each of said cross passages.

* * * * *